US005078102A

United States Patent [19]

Matsumoto

[11] Patent Number: 5,078,102

[45] Date of Patent: Jan. 7, 1992

[54] ENGINE VALVE DRIVING DEVICE

[76] Inventor: Takuya Matsumoto, 228, Kuroda 2-chome, Kanazawa-shi, Ishikawa-ken, Japan

[21] Appl. No.: 629,812

[22] Filed: Dec. 21, 1990

[30] Foreign Application Priority Data

Dec. 21, 1989 [JP] Japan ..... 1-331685

[51] Int. Cl.[5] ..... F01L 1/34

[52] U.S. Cl. ..... 123/90.15; 123/90.25; 123/90.17

[58] Field of Search ..... 123/90.15, 90.16, 90.17, 123/90.24, 90.25

[56] References Cited

U.S. PATENT DOCUMENTS

| | | | |
|---|---|---|---|
| 2,832,327 | 4/1958 | Lorenz | 123/90.24 |
| 2,954,017 | 9/1960 | Forstner | 123/90.16 |
| 3,641,988 | 2/1972 | Torazza et al. | 123/90.16 |
| 4,829,949 | 5/1989 | Holmer | 123/90.16 |
| 4,898,130 | 2/1990 | Parsons | 123/90.16 |

*Primary Examiner*—E. Rollins Cross

*Assistant Examiner*—Weilun Lo

*Attorney, Agent, or Firm*—Jones, Tullar & Cooper

[57] ABSTRACT

An engine valve driving device includes a rocker arm attached at one end to a valve stem and carrying at its opposite end a roller which engages the surfaces of a stepped cam plate. The cam plate has a horizontal surface which includes upper and lower portions joined by an inclined portion so that horizontal reciprocating motion operates the rocker arm and the connected valve. The cam plate is connected to a rotary cam crank shaft so that rotation of the crank shaft produces linear reciprocating motion in the cam plate. The connection between the cam shaft and the cam plate is adjustable, as by a hydraulic cylinder, to vary the gap between the cam plate and the cam shaft and to thereby vary the timing of the motion of the valve with respect to the rotation of the cam shaft. In an alternative form, the connection between the cam and the cam shaft may be a pivotal lever, with the pivot point of the lever being movable to provide timing adjustment.

16 Claims, 2 Drawing Sheets

ENGINE VALVE DRIVING DEVICE

BACKGROUND OF THE INVENTION

The present invention relates, in general, to a valve driving device which is used to drive the air intake and exhaust valves of internal combustion engines.

In accordance with the prior art, intake and exhaust valves for internal combustion engines have conventionally been driven by means of generally egg-shaped cams which are fixed to a cam axis and which press on the stem heads of corresponding valves by way of intermediate rocker arms. However, because there is a very small contact surface between the periphery of the egg-shaped cam and its corresponding rocker arm, rapid wearing of the surfaces occurred, causing misadjustment and warping. This not only led to difficulties with the resistance characteristics of the contacting surfaces, but also required extreme precision when manufacturing the egg-shaped cam itself.

In addition, in situations where variable timing was needed for an engine, the use of egg-shaped cams required both a low-speed cam and a high-speed cam to be mounted on the cam shaft, and further required a mechanism for switching between the two. However, the transition from a low speed to a high speed represented a change of engine specifications from that of an engine used in a general purpose automobile to those of an engine used in a racing car, and such a change was, in fact, extremely difficult to accomplish for ordinary engine operation.

SUMMARY OF THE INVENTION

In order to solve the foregoing problems, the present invention provides a valve driving mechanism which permits stepless variable timing to enable an engine to provide full output power at both low rotational speeds and at high rotational speeds.

In order to achieve the foregoing purpose, an engine valve driving device in accordance with the invention is characterized by a rocker arm which is pivoted at its center and is connected at one end to a valve stem in a conventional manner. The opposite end of the rocker arm, however, carries a roller which engages a plate-like cam having a shaped top surface which includes a lower horizontal part, an upper horizontal part and a linking inclined vertical portion which forms a step from the lower part to the upper horizontal part. This plate-like cam is characterized by being connected to an adjustable connecting member which is, in turn, secured to a cam shaft which rotates to drive the cam plate along a linear path, for example, in a horizontal plane so that the cam plate is capable of repeated advance and retreat movements. The adjustability of the connecting member enables the engine valve driving device of the present invention to reciprocate the plate-shaped cam in forward and backward directions from a predetermined but adjustable neutral, or set position.

In operation, rotation of the cam shaft causes the plate-shaped cam to repeatedly move back and forth in accordance with the rotation of the cam shaft. When the roller on the rocker arm contacts the lower horizontal part of the plate-shaped cam the corresponding valve is fully closed. As the plate shaped cam is moved, the roller moves up the inclined portion thereof to the upper horizontal part of the cam to move the valve to a fully open position. The inclined vertical step formed in the plate-shaped cam thus moves the valve between its fully closed and its fully open position as the cam moves back and forth.

The roller on the rocker arm is cylindrical and therefore produces a linear contact with the plate-shaped cam surface. This linear contact provides durability, and at the same time because of the plate-shaped cam, the construction of the mechanism is easier than was the case with egg-shaped cams.

The connection between the reciprocating plate-shaped cam and the rotary cam shaft preferably is a hydraulic cylinder, one end of which is connected to a crank shaft portion of the cam shaft and the other end of which includes a cylinder rod connected to the plate-shaped cam. The cylinder and rod can be activated to expand and contract to change the gap between the cam crank shaft and the plate-shaped cam. This adjustability of the location of the plate-shaped cam with respect to the crank shaft permits adjustment of the location of the contact between the surface of the plate-shaped cam and the roller carried by the rocker arm so that it is possible to change the timing of the valve motion with respect to the cam shaft rotation by changing this gap. As an alternative, the connection between the cam shaft and the plate-shaped cam can be by means of a pivotal lever arm, and in such a construction the timing of the valve can be changed by moving the pivotal axis of the lever.

BRIEF DESCRIPTION OF THE DRAWINGS

The foregoing, and additional objects, features and advantages of the present invention will be apparent from a consideration of the following detailed description of preferred embodiments thereof, taken in conjunction with the accompanying drawings, in which.

DESCRIPTION OF PREFERRED EMBODIMENT

Figure 1:
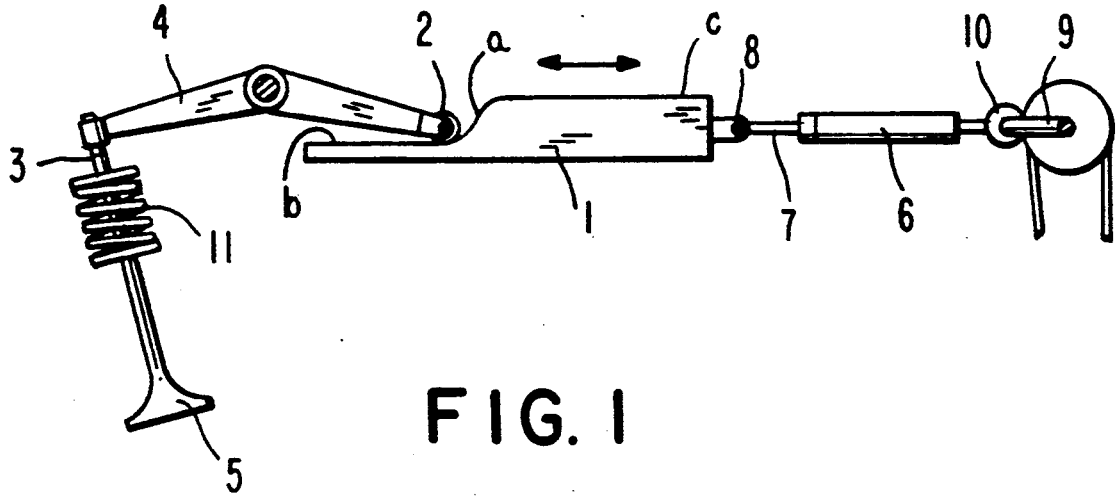
FIG. 1 is a side elevational view of a first embodiment of a cam mechanism in accordance with the present invention.
Figure 2:
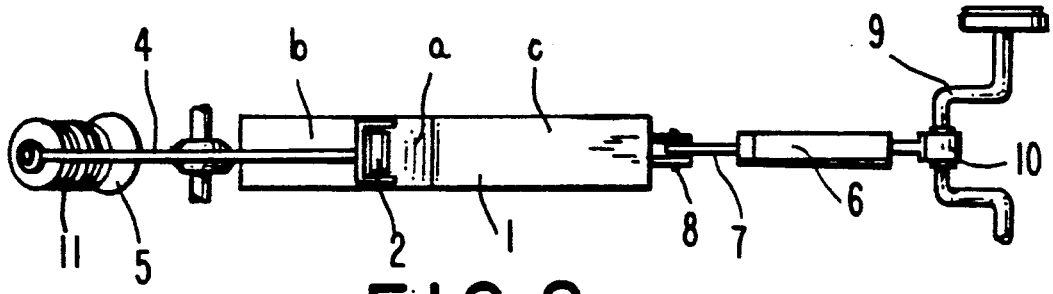
FIG. 2 is a top plan view of the device of FIG. 1.

Referring now to FIGS. 1 and 2, there is illustrated a plate-shaped cam 1 having a top surface which is shaped to provide an intermediate inclined portion 1*a*, a lower horizontal portion 1*b*, and an upper horizontal portion 1*c*, the surface portions 1*b* and 1*c* and the intermediate surface 1*a* forming a stepped cam plate surface configuration. The stepped surface 1*a*, 1*b*, 1*c* is contacted by a roller 2 which is attached to a valve stem 3 by way of a rocker arm 4 pivotally mounted at its center to a rocker arm shaft 4' in conventional manner.

The cam 1 is mounted for horizontal motion as indicated by the arrow 1' so that the roller 2 is brought into contact with a selected portion 1*a*, 1*b* or 1*c* of the upper surface of the cam. When the roller is in contact with the horizontal portion 1*b*, as illustrated in FIG. 1, the valve 5 connected to valve stem 3 is in its fully closed mode whereas when the roller contacts the upper horizontal portion 1*c*, the valve 5 is moved to its fully open mode.

A hydraulic cylinder 6, or similar adjustable connecting member, is connected by way of a cylinder rod 7 to a pivotal attachment 8 at the rearward end of the plate-shaped cam 1. The rearward portion of the hydraulic cylinder 6 is connected to a cam crank shaft 9 by means of a ring bearing 10 so that upon rotation of the cam shaft 9, the connector linkage including the adjustable hydraulic cylinder 6 will cause the cam 1 to move back and forth in a horizontal direction (as viewed in FIG. 1).

A conventional valve spring 11 is mounted on the valve stem 3, as illustrated in FIGS. 1 and 2, to urge the valve upwardly, thereby tending to rotate the rocker arm 4 is a clockwise direction as viewed in FIG. 1, thereby holding roller 2 in contact with the upper surfaces 1*b*, 1*a* and 1*c* of the cam 1.

Figure 3:
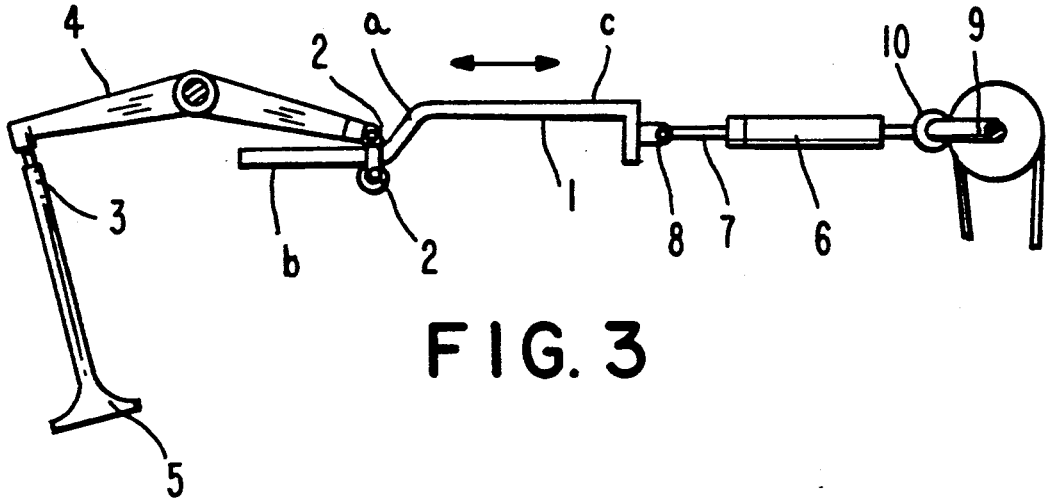
FIG. 3 is a side elevation view of a second embodiment of the cam adjustment mechanism of the present invention.

Another embodiment of the invention is illustrated in FIG. 3 wherein the plate-shaped cam is formed with a constant specified thickness and thereby has a bottom surface which is essentially the same shape as and parallel to the top surface. In this case, the rocker arm 4 carries a pair of spaced rollers 2 and 2', the roller 2 being secured by the rocker arm and the roller 2' being secured in a bracket 2'' which extends past the thickness of the cam plate 1 and secures roller 2' in contact with the bottom surface of the cam. The cam plate 1 is then held between rollers 2 and 2' on the upper and lower sides, respectively, so that the conventional valve spring 11 is not required. The motion of the cam plate 1 horizontally thus provides positive up and down motion of the valve stem 3 and the valve 5.

In the embodiment of FIG. 3, as well as in the embodiments of FIGS. 1 and 2, expansion and contraction of the connecting member between the plate-shaped cam 1 and the cam crank shaft 9, changes the distance between the crank shaft and the cam plate. This change in the gap, or length of the connecting member, changes the relative position of the roller 2 on the plate-shaped cam upper surface when the cam is moved back and forth by the rotation of cam shaft 9. This change in the relative position of the roller with respect to the rotational position of the cam shaft changes the timing of the opening and closing of valve 5. Accordingly, by controlling the expansion and contraction of the cylinder 6, the valve timing is also controlled.

Figure 4:
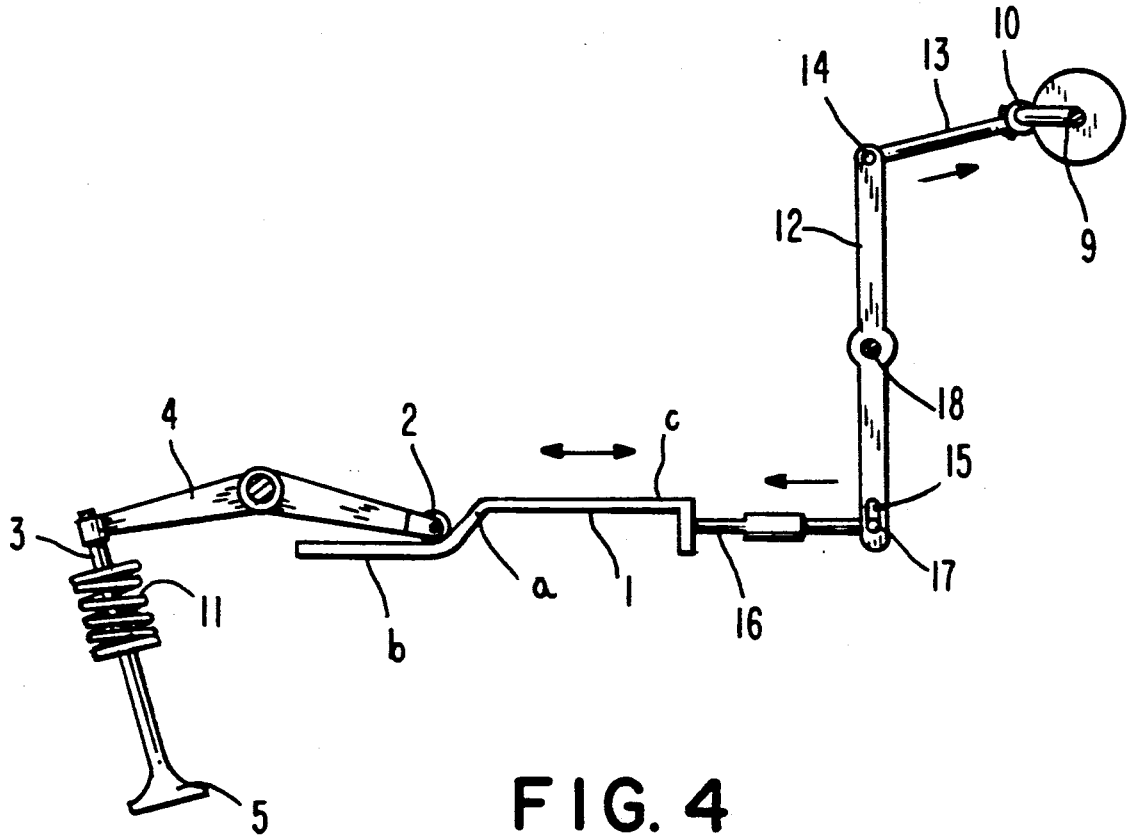
FIG. 4 is a side elevation of a third embodiment of the cam drive mechanism of the present invention.

In the embodiment of FIG. 4, the connecting member between cam 1 and cam shaft 9 is a lever 12 which includes at one end a connecting rod 13 secured at one end to the ring bearing 10 on crank shaft 9 of the cam shaft and connected at its other end to a pivotal connection 14 at the upper end of the lever. Similarly, the lower end of lever 12 incorporates an elongated aperture 15 which extends along a portion of the length of lever 12 and is generally vertical as illustrated in FIG. 4. A rod 15 is connected at one end to the cam 1 and at its opposite end is connected by means of a pin 17 in the aperture 15. The rod 16 may be adjustable in length, for example, by means of an adjustment mechanism 16'. In operation, rotation of the cam crank shaft 9 causes the lever 12 to pivot about a central mounting axis 18, and this pivotal motion in turn drives the plate-shaped cam 1 in the reciprocating movement described above so that the roller 2 contacts the upper surfaces 1*b*, 1*a* and 1*c* of the cam.

Variable valve timing can be achieved in the device of FIG. 4 either by movement of the pivotal axis 18 in the advance and retreat directions (that is, to the left or to the right as viewed in FIG. 4), or by utilizing an eccentric cam, or by adjusting the length of connector rod 16.

Since the present invention utilizes a plate-shaped cam, it is not necessary to use very fine precision in manufacturing the cam plate, and furthermore, cam operations are relatively easy. Furthermore, since the contact with the roller carried by the rocker arm is linear, the cam has good durability. Furthermore, the construction of the present invention makes it possible to easily adjust the timing of all of the valves in a multi-cylinder engine. Furthermore, it is possible to use a single cam surface for operating engines over a wide range of speeds to provide not only low speed rotation, but high speed rotation, as well. This eliminates the need for multiple cams which were required in the prior art.

What is claimed is:

1. An engine valve driving device which is characterized by having a rocker arm attached on one end to a valve stem and having on the other end a roller engaging the cam surface of a movable cam plate, said cam surface having upper and lower horizontal portions linked by an inclined vertical portion to form a stepped cam surface, said cam plate being connected to a cam crank shaft through a connecting member to produce repeated advance and retreat movements in said cam surface.

2. The engine valve driving device of claim 1, wherein said connecting member is adjustable to vary the timing of said valve with respect to said crank shaft.

3. An engine valve driving apparatus, comprising:

an engine valve having a valve stem;

a cam plate having a stepped surface;

a rocker arm having a first end engaging said valve stem and a second end engaging said cam plate stepped surface; and means driving said cam plate to cause said stepped surface to move with respect to said rocker arm, said second end of said rocker arm following said stepped surface to thereby drive said valve stem.

4. The apparatus of claim 3, wherein said rocker arm includes a roller on said second end engaging said cam plate stepped surface.

5. The apparatus of claim 4, wherein said means driving said cam plate comprises a cam shaft rotatable to drive said cam plate in a reciprocating motion.

6. The apparatus of claim 5, wherein said cam plate is mounted for movement in a generally horizontal plane, and wherein said stepped surface includes at least upper and lower generally horizontal portions and a generally vertical inclined portion joining said upper and lower portions, whereby horizontal motion of said cam plate produces vertical motion of said second end of said rocker arm.

7. The apparatus of claim 5, wherein said means driving said cam plate includes adjustable connector means connecting said cam shaft to said cam plate for adjusting the timing of the motion of said valve stem with respect to the motion of said cam shaft.

8. The apparatus of claim 7, wherein said connecting means includes a hydraulic cylinder for adjusting the length of said connecting means.

9. The apparatus of claim 7, wherein said connecting means includes a pivotally mounted lever having a first end connected to said cam shaft and a second end connected to said cam plate.

10. The apparatus of claim 9, wherein said pivotally mounted lever has a pivot point, said pivot point being movable to adjust the timing of the motion of said valve stem with respect to the motion of said cam shaft.

11. The apparatus of claim 3, wherein said cam plate includes a top stepped surface, and a bottom stepped surface parallel to and spaced from said top stepped surface, and wherein said rocker arm includes roller means engaging said top and bottom stepped surfaces to drive said valve stem in a reciprocating motion.

12. Adjustable engine valve driving apparatus for varying the timing of valve operation to control engine operation at both low and high rotational speeds, comprising:

a rotating cam crank shaft;

valve means including a valve stem;

a movable cam plate having at least one cam surface shaped to control the motion of said valve means;

first connector means having a first end contacting said cam surface and movable to follow the shape of said surface, and a second end connected to drive said valve means in accordance with the motion of said first end of said connector means; and second connector means having a first end connected to said cam plate and a second end connected to said crank shaft, whereby rotation of said crank shaft causes said cam plate to reciprocate along a predetermined path to thereby move said shaped cam surface with respect to said first connector means to drive said valve means, said second connector means being adjustable to vary the timing of the motion of said valve with respect to the rotation of said cam crank shaft.

13. The apparatus of claim 12, wherein said second connector means is adjustable in length.

14. The apparatus of claim 12, wherein said second connector means is adjustable in location.

15. The apparatus of claim 12, wherein said second connector includes a hydraulic cylinder for adjusting its length.

16. The apparatus of claim 12, wherein said cam surface includes an upper portion, a lower portion, and an intermediate inclined portion joining said upper and lower portions, the reciprocation of said cam plate causing said first end of said first connector means to contact said upper, intermediate and lower portions to reciprocate said valve means.

* * * * *